United States Patent [19]

Dehne

[11] Patent Number: 4,745,865

[45] Date of Patent: May 24, 1988

[54] CARRIER STORAGE TRACK FOR POWER AND FREE CONVEYORS

[75] Inventor: Noel F. Dehne, Farmington Hills, Mich.

[73] Assignee: Jervis B. Webb Company, Farmington Hills, Mich.

[21] Appl. No.: 52,847

[22] Filed: May 20, 1987

[51] Int. Cl.[4] ..... B61B 10/00; B65G 17/42

[52] U.S. Cl. ..... 104/172.3; 104/96; 104/172.1

[58] Field of Search ..... 104/89, 91, 96, 106, 104/130, 165, 172.1, 172.3, 172.4

[56] References Cited

U.S. PATENT DOCUMENTS

| | | | |
|---|---|---|---|
| 3,174,438 | 3/1965 | Hariton | 104/172.4 |
| 3,195,473 | 7/1965 | Dehne | 104/172.4 |
| 3,404,636 | 10/1968 | Kavieff | 104/96 |
| 3,518,946 | 7/1970 | Kavieff | 104/172.3 |
| 3,712,241 | 1/1973 | Kuwertz | 104/172.4 |
| 3,915,287 | 10/1975 | Seymour | 104/172.4 |
| 4,031,829 | 6/1977 | Bell et al. | 104/172.4 |
| 4,279,201 | 7/1981 | Solomon | 104/96 |
| 4,408,540 | 10/1983 | Dehne | 104/172.3 |
| 4,615,570 | 10/1986 | Dehne | 104/172.3 |
| 4,669,388 | 6/1987 | Dehne et al. | 104/172.3 |

*Primary Examiner*—George L. Walton

*Attorney, Agent, or Firm*—Joseph W. Farley

[57] ABSTRACT

A storage track section for a power and free conveyor system having carriers each comprising a leading driving trolley, a first load carrying trolley connected to the driving trolley by a tow bar, and a second load carrying trolley connected to the first load carrying trolley by load carrying structure. The storage track section includes parallel first and second load tracks which respectively support the first and second load carrying trolleys and are transversely spaced apart a distance less than the length of the load carrying structure; and, includes a driving trolley track located intermediate and parallel to the load tracks and transversely spaced from the first load track a distance less than the length of the tow bar. An entrance section to the storage track section is so arranged that the three trolleys of each carrier are diverted to their respective storage section tracks in a sequence which places the tow bar and the load carrying structure in a jackknifed relation, thereby enabling a given number of carriers to be stored in a minimum area.

3 Claims, 2 Drawing Sheets

CARRIER STORAGE TRACK FOR POWER AND FREE CONVEYORS

BACKGROUND OF THE INVENTION

This invention relates to power and free conveyor systems and particularly to an improved storage track section on which a plurality of multi-trolley carriers can be stored in accumulated relation in a minimum area for a given number of carriers.

A power and free conveyor includes a power track which supports power trolleys connected to an endless driven chain equipped with longitudinally spaced pushers, and a carrier track normally arranged in vertically spaced relation with the power track, a plurality of carriers being mounted on the carrier track. Each of these carriers, for purposes of the present invention, comprises a leading driving trolley, a first load carrying trolley connected to the driving trolley by a tow bar, and a second load carrying trolley connected to the first load carrying trolley by suitable load carrying structure. The driving trolley is provided with a driving dog which is engageable by one of the pushers and which is disengageable from the pusher by operating mechanism responsive to contact between the driving trolley and the rear trolley of a preceding, stopped carrier. Carriers of the foregoing type are shown in U.S. Pat. Nos. 4,408,540 and 4,616,570 to which reference is made.

U.S. Pat. No. 4,408,540, FIG. 1, illustrates a power and free conveyor system having portions in which the first and second load carrying trolleys of the carriers travel on a pair of parallel tracks so that the load carrying structure connecting these trolleys is placed in an oblique relation to the tracks, thus reducing the longitudinal spacing between successive carriers. In other power and free conveyor systems, the longitudinal spacing between successive carriers has been further reduced by providing three parallel tracks, one for each of the three trolleys of the carrier, the three tracks being arranged so that the entire carrier structure in substantially longitudinally aligned relation, extends obliquely to the three tracks. This three-track arrangement requires considerable space, since the overall transverse dimension of the conveyor must be increased.

SUMMARY OF THE INVENTION

The present invention provides, in a power and free conveyor having carriers each equipped with three trolleys as described above, a storage track section on which a plurality of carriers can be accumulated on three tracks so arranged that each carrier entering the storage track section is progressively placed with its tow bar and load carrying structure in a jackknifed relation; and, so arranged that each carrier leaving the storage track section is progressively unfolded from the jackknifed relation to a normal condition in which the tow bar and load carrying structure are longitudinally aligned.

The storage track section comprises first and second parallel load tracks for the first and second load carrying trolleys of each carrier, and a driving trolley track for the driving trolley of each carrier. The first and second load tracks are spaced apart transversely by a load track distance which is less than the normal longitudinal spacing between the load carrying trolleys as determined by the length of the load carrying structure connecting the load carrying trolleys. The driving trolley track, which is arranged in vertically spaced relation with the power track, is located intermediate and parallel to the first and second load tracks and is spaced transversely from the first load track by a driving track distance which is less than normal longitudinal spacing between the driving trolley and the first load carrying trolley, as determined by the length of the tow bar connecting the driving and first load carrying trolleys.

An extrance section to the storage track section connects a main carrier track, on which all of the carrier trolleys travel, to the first and second load tracks and to the driving trolley track. This entrance section includes a first junction at which the main carrier is connected to the second load track and to a transition track, and at which switch means diverts the driving and first load trolley to the transition track and the second load trolley to the second load track; and, a second junction at which the transition track is connected to the first load track and to the driving trolley track. The transition track has a first portion extending from the first junction at an acute angle to the second load track and a second portion extending from the first portion to the second junction in parallel, load track distance relation to the second load track. At the second junction, the driving trolley track extends toward the second load track to the driving track distance from the first load track and at an acute angle relative thereto; and switch means diverts the driving trolley to the driving trolley track and the first load carrying trolley to the first load track, thereby placing the tow bar and the load carrying structure of each carrier in a jackknifed relation along the three parallel first and second load and driving trolley tracks.

An exit section connects the storage track section back to a continuation of the main carrier track and includes converging track means between the second load track, the driving trolley track and the first load track for unfolding the tow bar and the load carrying structure of each carrier from the jackknifed relation to a longitudinally aligned relation by sequentially advancing the driving trolley, the first load carrying trolley and the second load carrying trolley from the three parallel storage section tracks on to the continuation of the main carrier track.

Other features of the invention will appear from the description to follow of the embodiment shown in the accompanying drawings.

DESCRIPTION OF THE PREFERRED EMBODIMENT

Figure 1:
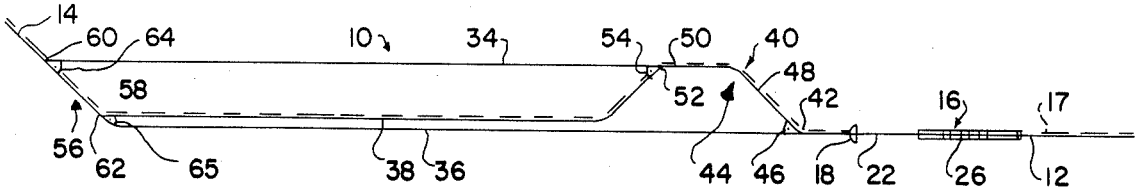
FIG. 1 is a schematic plan view showing a storage track section of the invention provided in a portion of a power and free conveyor system.

In FIG. 1, a storage track section 10 is provided between a main carrier track 12 of a power and free conveyor and a continuation 14 of the main carrier track, the conveyor being constructed and equipped with carriers 16 such as disclosed in the above-referenced U.S. Pat. No. 4,616,570. Carrier trolley tracks in FIG. 1 are shown in solid lines; a power track 17, which supports power trolleys connected to an endless driven chain equipped with longitudinally spaced pushers, is shown in broken line.

Figure 3:
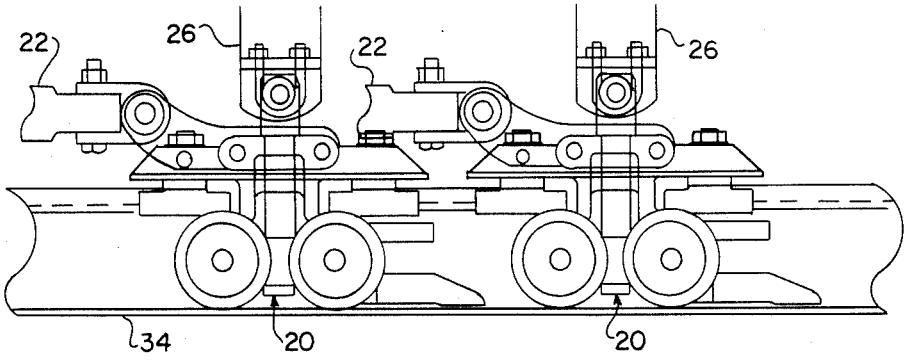
FIG. 3 is a side elevation, taken as indicated by the arrows 3—3 of FIG. 2, showing the first load carrying trolleys of successive, accumulated carriers.
Figure 4:
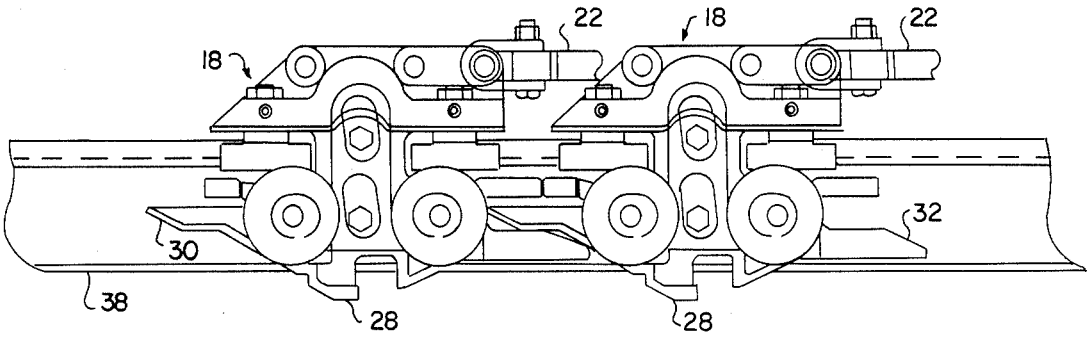
FIG. 4 is a side elevation, taken as indicated by the arrows 4—4 of FIG. 2, showing the driving trolleys of successive, accumulated carriers.

Each carrier 16 comprises a leading driving trolley 18 (FIG. 4), a first load carrying trolley 20 (FIG. 3) trailing the driving trolley 18 and connected by a tow bar 22 to the driving trolley at a first longitudinal spacing along the main carrier track, and a second load carrying trolley 24 identical to and trailing the first load carrying trolley 20. The second load carrying trolley 24 is connected to the first load carrying trolley 20 by load carrying structure 26 at a second longitudinal spacing along the main carrier track. A movable driving dog 28 (FIG. 4) is mounted on each driving trolley 18, is normally engageable by one of the power track pushers, and is disengageable from the pushers by operating means comprising a cam 30 formed with the driving dog and engageable with an actuator 32 on the rear of a preceding stopped driving trolley, as shown in FIG. 4. Not shown in this view are the power track and pushers which are vertically spaced below the driving trolleys 18 as taught by the referenced patents.

The storage track section 10 comprises first and second load tracks 34 and 36 for the first and second load carrying trolleys 20 and 24, respectively, the load tracks 34 and 36 being parallel to each other and spaced apart transversely a distance (hereafter called a load track distance) which is less than the normal or second longitudinal spacing between the load carrying trolleys 20 and 24. A driving trolley track 38, which is arranged in vertically spaced relation with the power track 17, is located transversely intermediate and parallel to the load tracks 34 and 36, and is transversely spaced from the first load track 34 by a driving track distance, namely, a distance less than the normal or first longitudinal spacing between the driving trolley 18 and the first load carrying trolley 20. The three tracks 34, 36 and 38 are connected to the main carrier track 12 by an entrance section 40.

The entrance section 40 comprises a first junction 42 which connects the main carrier track 12 to the second load track 36 and to a transition track 44 arranged in vertically spaced relation with the power track 17. First junction switch means 46 diverts the driving trolley 18 and the first load carrying trolley 20 to the transition track 44, and diverts the second load carrying trolley 24 to the second load track 36.

A first portion 48 of the transition track 44 extends from the first junction 42 at an acute angle to the second load track 36; a second portion 50 of the transition track 44 extends from the first portion 48 to a second junction 52 in parallel relation to the second load track 36 and at the load track distance therefrom. The second junction 52 connects the transition track portion 50 to the first load track 34 and to the driving trolley track 38 which extends from the second junction 52 toward the second load track 36 at an acute angle to the first load track 34, and to the driving track distance from the first load track. Second junction switch means 54 diverts the driving trolley 18 to the driving trolley track 38 and the first load carrying trolley 20 to the first load track 34.

Figure 2:
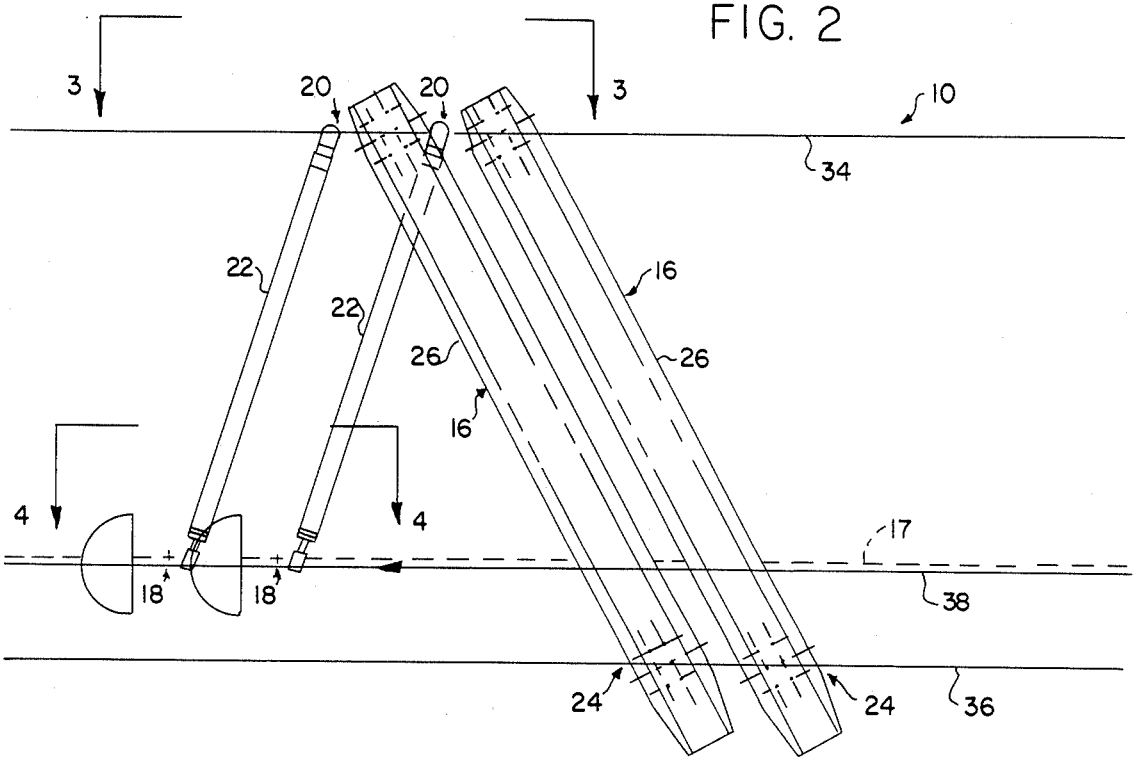
FIG. 2 is an enlarged plan view showing the relation between carriers of the conveyor, accumulated on the storage track section of FIG. 1.

As a result of the entrance section 40 track and junction progression, carriers 16 on the parallel tracks 34, 36 and 38 of the storage track section 10 have their tow bars 22 and load carrying structures 26 placed in a jackknifed relation, as shown by FIG. 2. The carriers 16 in this jackknifed condition can be propelled through the storage track section 10, and can be stopped and accumulated as shown in FIGS. 2, 3 and 4, as desired. The storage track section provides dense accumulation in a minimum floor area for a given number of carriers and also reduces the amount of safety guard installation that may be required around the area.

An exit section 56 connects the three carrier tracks 34, 36 and 38 of the storage track section to the main carrier track continuation 14 by an exit track 58 which provides a convergence of the driving trolley track 38 with the first and second load tracks 34 and 36. The arrangement of the exit track 58 relative to the other tracks of the exit section is such that the driving trolley 18, the first load carrying trolley 20 and the second load carrying trolley 24 are sequentially advanced and placed on the main carrier track continuation 14.

In the representative arrangement of the exit section shown in FIG. 1, the exit track 58 comprises a driving trolley track portion which is accompanied by the power track 17 and extends at an acute angle to the first load track 34 to a first exit junction 60 between the exit track 58, the first load track and the main carrier track continuation 14. A second exit junction 62 connects the second load track 36 to the exit track 58. A switch 64 and a switch 65 at the first and second exit junctions 60 and 62, respectively, permit the driving trolley 18, the first load carrying trolley 20 and the second load carrying trolley 24 of each carrier 16 to be advanced successively to the main carrier track continuation, thereby progressively unfolding the carrier 16 from its jackknifed condition.

Other configurations of the exit section 56 are possible depending upon the desired direction of travel of the main carrier track continuation 14 in a particular power and free conveyor system in which the storage track section 10 of the invention is incorporated.

I claim:

1. In a power and free conveyor having a power track, power means supported by the power track and including an endless driven chain equipped with longitudinally spaced pushers; a main carrier track normally arranged in vertically spaced relation with the power track, and a plurality of carriers mounted on the main carrier track; each carrier comprising a leading driving trolley having a driving dog engageable by one of said pushers and operating means for disengaging the driving dog therefrom, a first load carrying trolley trailing the driving trolley, a tow bar connecting the first load carrying trolley to the driving trolley at a first longitudinal spacing along the main carrier track, a second load carrying trolley trailing the first load carrying trolley, and load carrying structure connecting the second load carrying trolley to the first load carrying trolley at a second longitudinal spacing along the main carrier track;

storage track means for accumulating a plurality of carriers in a minimum spatial requirement, said storage track means comprising;

first and second parallel load tracks for said first and second load carrying trolleys, respectively, said first and second load tracks being spaced apart transversely a load track distance less than said second longitudinal spacing;

a driving trolley track arranged in vertically spaced relation with said power track, said driving trolley track being located transversely intermediate and parallel to said first and second load tracks, said driving trolley track being spaced transversely from said first load track by a driving track distance less than said said first longitudinal spacing; and an entrance section connecting said main carrier track to said first and second load tracks and to said driving trolley track, said entrance section comprising:

a first junction connecting said main carrier track to said second load track and to a transition track, first junction switch means for diverting said driving trolley and said first load carrying trolley to said transition track and for diverting said second load carrying trolley to said second load track, said power track being arranged in vertically spaced relation with said transition track;

a second junction connecting said transition track to said first load track and to said driving trolley track, said transition track having a first portion extending from said first junction at an acute angle to said second load track and a second portion extending from said first portion to said second junction in parallel relation to said second load track at said load track distance, said driving trolley track extending from said second junction toward said second load track to said driving track distance from said first load track at an acute angle thereto, and second junction switch means for diverting said driving trolley to said driving trolley track and said first load carrying trolley to said first load track whereby said tow bar and load carrying structure are placed in a jackknifed relation on said parallel first and second load and driving trolley tracks.

2. A power and free conveyor according to claim 1 further comprising an exit section connecting said storage track means to a continuation of said main carrier track, said exit section including exit track means converging said driving trolley track with said first load track and said second load track for unfolding said tow bar and load carrying structure from said jackknifed relation to a longitudinally aligned relation by sequentially placing said driving trolley, said first load carrying trolley and said second load carrying trolley on said continuation of the main carrier track.

3. A power and free conveyor according to claim 1 further comprising an exit section connecting said storage track means to a continuation of said main carrier track; said exit section including a driving trolley track portion extending to said main carrier track continuation at an acute angle to said first load track; a first exit junction between said driving trolley track portion, said first load track and said main carrier track continuation; a second exit junction between said driving trolley track portion and said second load track; and switch means at said first and second exit junctions for successively diverting said driving trolley, said first load carrying trolley and said second load carrying trolley from said storage track means to said main carrier track continuation.

* * * * *